US005718324A

United States Patent [19]

Belvederi

[11] Patent Number: 5,718,324

[45] Date of Patent: Feb. 17, 1998

[54] CONTINUOUS CIGARETTE MANUFACTURING MACHINE

[75] Inventor: Bruno Belvederi, Via Giovanni, Italy

[73] Assignee: G.D Societá Per Azioni, Bologna, Italy

[21] Appl. No.: 541,503

[22] Filed: Oct. 10, 1995

[30] Foreign Application Priority Data

Oct. 13, 1994 [IT] Italy ..... B094A0449

[51] Int. Cl.[6] ..... B65G 29/00

[52] U.S. Cl. ..... 198/475.1; 198/474.1

[58] Field of Search ..... 198/343.1, 343.2, 198/474.1, 475.1, 478.1

[56] References Cited

U.S. PATENT DOCUMENTS

| | | | |
|---|---|---|---|
| 2,007,981 | 7/1935 | Nordquist | 198/478.1 |
| 3,010,561 | 11/1961 | Ricke | 198/474.1 X |
| 5,154,278 | 10/1992 | Deutsch | 198/475.1 |
| 5,353,909 | 10/1994 | Mukai et al. | 198/343.2 |

FOREIGN PATENT DOCUMENTS

| | | | |
|---|---|---|---|
| 2905376 | 8/1980 | Germany | 198/474.1 |
| 0241062 | 11/1986 | Germany | 198/478.1 |

*Primary Examiner*—James R. Bidwell
*Attorney, Agent, or Firm*—Ladas & Parry

[57] ABSTRACT

A continuous cigarette manufacturing machine presenting at least two outputs for respective items; the outputs being located at a loading station, and successively feeding the respective items directly into respective pockets on a conveyor wheel presenting a drive shaft rotating continuously about its axis; the pockets are divided into groups, each presenting a number of pockets equal to the number of outputs; and each group of pockets defines a respective conveying unit movable with the drive shaft and oscillating in relation to the drive shaft by virtue of a single cam device common to all the conveying units.

11 Claims, 2 Drawing Sheets

CONTINUOUS CIGARETTE MANUFACTURING MACHINE

BACKGROUND OF THE INVENTION

The present invention relates to a continuous cigarette manufacturing machine.

In particular, the present invention relates to a machine wherein a continuous conveyor member is supplied successively, at a loading station, with items defined at least partly by a number of cigarettes, and feeds the items along a given path along which they are variously manipulated.

For the sake of simplicity, in the following description, reference is made purely by way of example to a specific type of manufacturing machine comprising a packing machine, wherein the above conveyor member comprises a wrapping wheel, and the items manipulated comprise groups of cigarettes fed out of a feedbox and each ultimately forming the content of a respective packet.

Currently used cigarette manufacturing systems normally comprise one or more normally intermittent-operating packing machines, i.e. of the type wherein the cigarettes, supplied in bulk to the input feedbox of the packing machine, are withdrawn from the feedbox and fed in groups, normally comprising twenty cigarettes, to a step conveyor. This normally presents a succession of pockets which, as the conveyor moves forward in steps, are successively arrested at a loading station in front of the feedbox to receive a respective group of cigarettes. Once formed and loaded on to the step conveyor, the groups of cigarettes are fed to a manipulating and wrapping line along which they are fed in steps and subjected to a number of wrapping operations at a given number of stops between one step and the next.

Though highly efficient and reliable, intermittent packing machines of the above type obviously present a number of drawbacks typical of any intermittent mechanism, and which, mainly on account of the high operating speeds involved, result in severe vibration and hence a high noise level, and in relatively high maintenance costs.

To overcome the above drawbacks and, at the same time, permit even higher operating speeds, so-called "continuous" packing machines have for some time been devised, and numerous patents have been filed, including, for example, European Patents n. 210,544 and 435,087, and British Patent n. 1,497,221.

The above patents all relate to continuous packing machines, wherein an input feedbox with a number of outputs is connected to a continuous wrapping wheel, i.e. rotating at substantially constant angular speed about its axis, by an intermediate conveyor normally presenting a succession of pockets, and which receives groups of cigarettes at a loading station at the output end of the feedbox, and transfers them successively to an unloading station where they are unloaded on to the wrapping wheel. The intermediate conveyor is either a step-feed type, as in the case of European Patent n. 435,087, or a combination-feed type, i.e. intermittent at the loading station and continuous at the unloading station.

The solution proposed in the above patents, however, is far from satisfactory. Firstly, on account of the presence of the intermediate conveyor which involves a considerable increase in the length of the packing line of the packing machine and the supporting frame; and secondly on account of the intermediate conveyors described all being connected to intermittent devices which compel the packing machines—otherwise continuous—to operate within the speeds typical of currently used intermittent machines.

SUMMARY OF THE INVENTION

It is an object of the present invention to provide a packing machine designed to overcome the aforementioned drawbacks.

According to the present invention, there is provided a continuous cigarette manufacturing machine comprising drive means; a number of conveying pockets, each for receiving an item defined at least partly by a number of cigarettes; transmission means interposed between said pockets and said drive means, which are moved continuously to successively move the pockets along a given path; a loading station along said path; and supply means for supplying said items, and presenting at least two outputs located at the loading station and for feeding said items directly into the respective said pockets; characterized in that it comprises a number of wrapping units, each in turn comprising a number of said pockets equal to the number of said outputs, and a conveying element by which the relative said pockets are made integral with one another with the same spacing as said outputs; each conveying element being connected to a respective transmission means; and each transmission means being provided with control means for imparting to the relative conveying element given movements in relation to said drive means.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
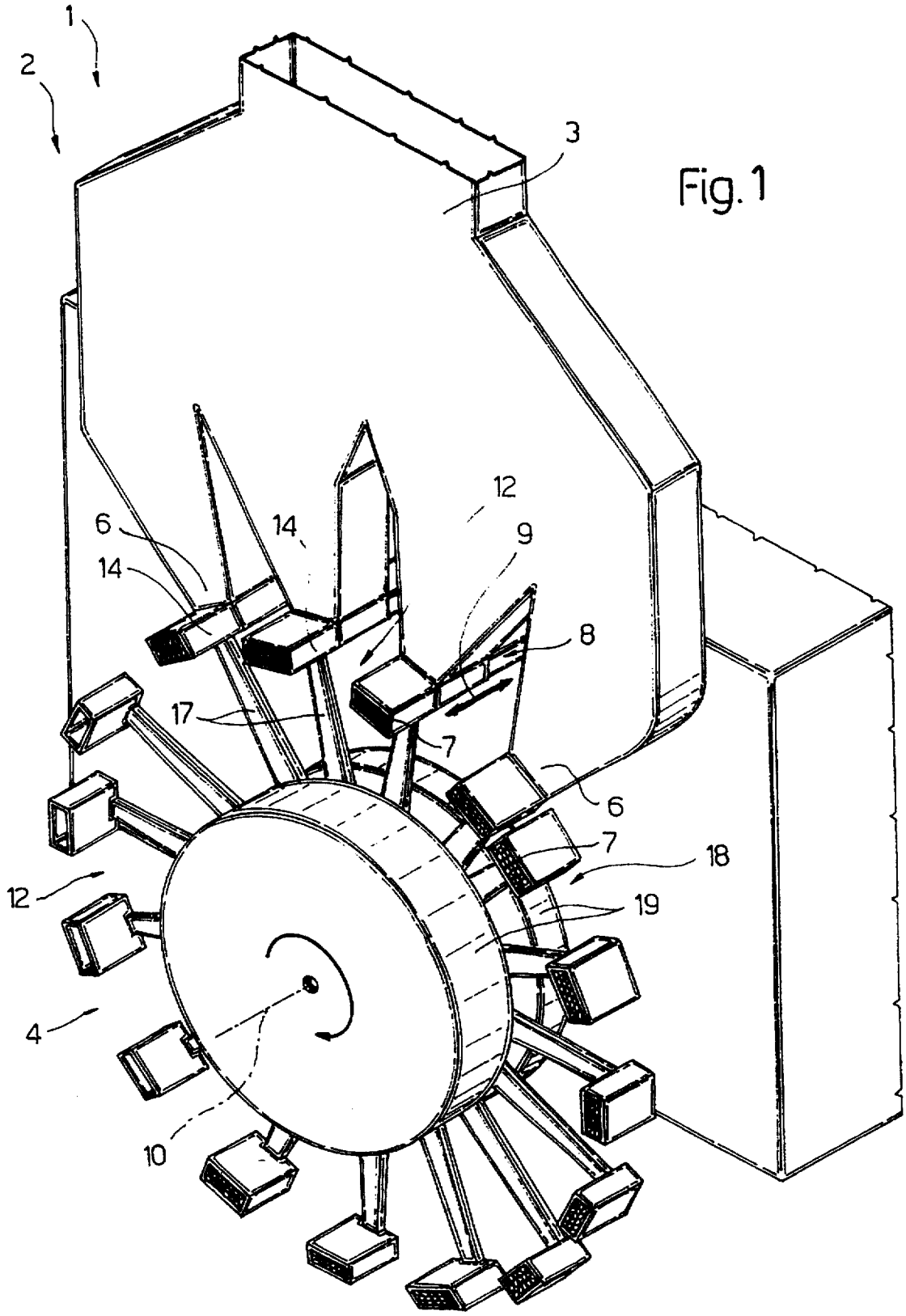
FIG. 1 shows a schematic view in perspective of a preferred embodiment of the input portion of the packing machine according to the present invention.
Figure 2:
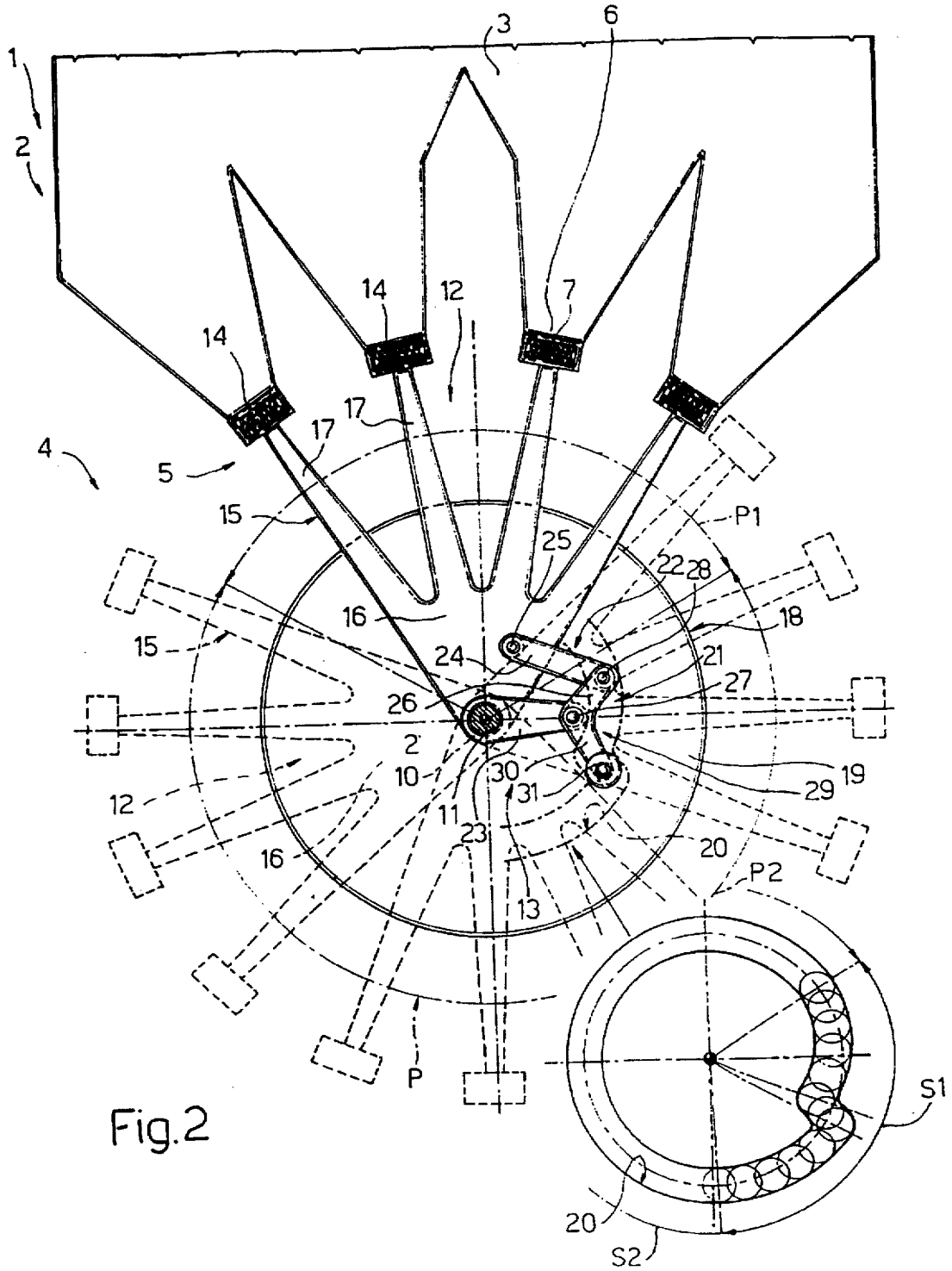
FIG. 2 shows a schematic cross section of the FIG. 1 portion of the packing machine.

Numeral 1 in FIGS. 1 and 2 indicates a continuous cigarette manufacturing machine comprising, in the example shown, a continuous packing machine, the input portion 2 of which comprises a feedbox 3, and a wrapping wheel 4 connected directly to feedbox 3 at a loading station 5.

In the example shown, feedbox 3 comprises four outputs 6—which may be more than four but no fewer than two—for respective items 7, each defined at least partly by a number of cigarettes forming the content of a packet (not shown). For each output 6, feedbox 3 also comprises a known extracting device 8 movable back and forth, simultaneously with the other extracting devices 8, through output 6 and in direction 9 parallel to the axes of the cigarettes (not shown) inside feedbox 3, to successively feed items 7 on to wheel 4 at station 5.

Wheel 4 rotates continuously about its axis 10 substantially parallel to direction 9, to feed items 7 along a substantially circular path P comprising a loading arc P1 extending through station 5 and along which outputs 6 are preferably, but not necessarily, equally spaced with a spacing D1, and a wrapping and unloading arc P2 complementary to arc P1.

Wheel 4 comprises a central drive shaft 11 coaxial with and rotating clockwise (in FIG. 2) about axis 10 at a substantially constant angular speed; a number of wrapping units 12 connected for rotation to shaft 11; and a number of transmission devices 13, each interposed between shaft 11 and a respective unit 12.

Each unit 12 comprises a number of conveying pockets equal in number to outputs 6, and each for housing a respective item 7.

In the example shown, each pocket comprises a tubular folding spindle 14 extending parallel to axis 10 and for receiving a respective item 7 withdrawn in known manner from a respective output 6 by respective extracting device 8.

Each unit 12 also comprises a conveying element 15 moved about axis 10 by respective transmission device 13 and defined by a central sector 16 mounted for rotation on shaft 11, and by a number of radial arms 17, each of which connects a respective spindle 14 to sector 16, and is so oriented in relation to the other arms 17 that the spindles 14 of respective unit 12 present the same spacing as outputs 6.

Wheel 4 has a control device 18 comprising two opposed, fixed disks 19 on either side of units 12 and coaxial with shaft 11. On the side facing units 12, one of disks 19 presents an annular cam groove 20 connected to each transmission device 13 by a respective tappet actuating device 21, to control the angular position of units 12 in relation to shaft 11.

Each transmission device 13 comprises an articulated parallelogram 22, in turn comprising a first crank 23 fitted to shaft 11, a second crank 24 connected to relative sector 16 by a pin 25 parallel to axis 10, and a connecting rod 26 hinged to the free ends of cranks 23, 24 by respective pins 27, 28 parallel to pin 25. Connecting rod 26 forms one arm of a rocker arm 29 pivoting on pin 27 and comprising a second arm 30 forming part of device 21 and fitted on its free end with a tappet roller 31 engaging in rolling manner in cam groove 20.

Consequently, each in cam groove 20 is engaged by a number of rollers 31 equal to the number of units 12, and imparts the same movement to each roller 31; which movement provides for oscillating relative rocker arm 29, and hence relative sector 16, in controlled manner in relation to shaft 11. The above oscillation of each unit 12 is such that, as relative spindles 14 travel along arc P1 and relative roller 31 travels along a corresponding arc Sl shown in detail in FIG. 2, relative sector 16 first rotates about axis 10 to assume an angular speed greater than that of shaft 11, and then, by virtue of the shape of groove 20, is arrested in relation to shaft 11 and begins reversing, in relation to shaft 11, at a gradually increasing angular speed until it reaches the same speed as shaft 11.

In other words, at least along a central portion of arc Sl, groove 20 is so formed that, when the spindles 14 of each unit 12 are positioned substantially coaxial with respective outputs 6 in station 5, they are arrested in space for a given hold time, which time is utilized by extracting device 8 to insert a respective item 7 inside each spindle 14 arrested in front of a respective output 6, and each sector 16 is restored to its position in relation to the other sectors 16 before reaching wrapping and unloading arc P2.

Moreover, as shown in FIG. 2, at least along a portion S2 corresponding to a central portion of arc P2, groove 20 is so formed that units 12 are all maintained the same distance apart, so that spindles 14 are all substantially equally spaced by spacing D2 equal to spacing D1, to enable a succession of known wrapping operations to be performed on each spindle 14 by known folding and gumming devices (not shown) located along arc P2.

What is claimed is:

1. A continuous cigarette manufacturing machine comprising a plurality of wrapping units, each including a conveying element, and a number of conveying pockets each for receiving an item defined at least partly by a number of cigarettes, said conveying pockets being connected to said conveying element so as to be integral with one another and in a fixed relationship to one another relative to spacing and orientation; drive means; transmission means interposed between each said conveying element and said drive means, said drive means being continuously driven to successively move the pockets along a given path; a loading station along said path; and supply means for supplying said items including a plurality of outputs located at the loading station for feeding respective said items directly into respective said pockets of a respective said wrapping unit; the pockets of each wrapping unit being equal in number to the number of said outputs and being spaced along said path at a spacing equal to the spacing of said outputs; each transmission means including control means for imparting to the respective conveying element given movements in relation to said drive means.

2. A machine as claimed in claim 1, wherein each conveying element is mounted so as to oscillate about an axis in relation to said drive means; said control means imparting to each conveying element controlled oscillations about said axis and along said path.

3. A machine as claimed in claim 2, wherein said control means comprise a cam device, and tappet actuating devices connected to the cam device (20) and associated with each wrapping unit; said cam device controlling all the actuating devices according to a given movement common to all the actuating devices.

4. A machine as claimed in claim 3, wherein said cam device is so formed as to reverse each conveying element at said loading station, and so arrest the respective pockets for a given time at the respective said outputs.

5. A machine as claimed in claim 4, wherein said cam device is so formed as to substantially equally space said pockets along a portion of said path outside said loading station.

6. A machine as claimed in claim 5, wherein said drive means comprises a shaft coaxial with and rotating about said axis; said path being a circular path; and said cam device being an annular cam device extending about said axis.

7. A machine as claimed in claim 6, wherein each said transmission means comprises an articulated parallelogram, in turn comprising two cranks, a first of which is fitted to said shaft, and a second of which is hinged to the relative said conveying element, and a connecting rod interposed between said cranks; the relative said tappet actuating device being connected to said connecting rod to vary its angular position in relation to the first crank.

8. A machine as claimed in claim 7, wherein each said connecting rod forms a first arm of a respective rocker arm pivoting on the associated first crank; the respective said tappet actuating device comprising a second arm of said rocker arm, and a tappet roller connected to said cam device.

9. A machine as claimed in claim 1, which it is a cigarette packing machine; said supply means comprising an input feedbox for supplying cigarettes; and each said item comprising a group of cigarettes placed together to form, at least partly, the content of a packet of cigarettes.

10. A machine as claimed in claim 9, wherein each said pocket comprises a tubular folding spindle for receiving a respective said group of cigarettes.

11. A machine as claimed in claim 10, wherein said drive means comprises a shaft rotating about an axis; said spindles being parallel to said axis and crosswise to said path.

* * * * *